US006591063B2

(12) United States Patent
Rochelle

(10) Patent No.: US 6,591,063 B2
(45) Date of Patent: Jul. 8, 2003

(54) BATH TEMPERATURE MAINTENANCE HEATER

(75) Inventor: Gary P. Rochelle, Marina Del Rey, CA (US)

(73) Assignee: Alpha-Western Corporation, Gardena, CA (US)

( * ) Notice: Subject to any disclaimer, the term of this patent is extended or adjusted under 35 U.S.C. 154(b) by 76 days.

(21) Appl. No.: 09/813,512

(22) Filed: Mar. 20, 2001

(65) Prior Publication Data

US 2002/0136544 A1 Sep. 26, 2002

(51) Int. Cl.[7] ..... F24H 1/10

(52) U.S. Cl. ..... 392/485; 392/488

(58) Field of Search ..... 392/485, 501, 392/471, 487–490

(56) References Cited

U.S. PATENT DOCUMENTS

| | | | | |
|---|---|---|---|---|
| 1,140,864 A | | 5/1915 | Aubery | |
| 2,266,216 A | * | 12/1941 | Kimberlin | 4/411 |
| 3,952,182 A | | 4/1976 | Flanders | |
| 4,208,570 A | * | 6/1980 | Rynard | 123/142.5 E |
| 4,556,168 A | | 12/1985 | Romanow et al. | |
| 4,725,714 A | | 2/1988 | Naya et al. | |
| 4,855,569 A | * | 8/1989 | Wiedemann | 392/461 |
| 4,859,345 A | | 8/1989 | Inagaki | |
| 4,924,069 A | * | 5/1990 | Giordani | 392/485 |
| 4,947,025 A | | 8/1990 | Alston et al. | |
| 5,408,578 A | | 4/1995 | Bolivar | |
| 6,080,971 A | | 6/2000 | Seitz et al. | |

FOREIGN PATENT DOCUMENTS

| | | |
|---|---|---|
| JP | 53-148752 | 5/1977 |
| JP | 59-71946 | 4/1984 |
| JP | 279386 | 3/1990 |

* cited by examiner

*Primary Examiner*—Teresa Walberg
*Assistant Examiner*—Thor Campbell
(74) *Attorney, Agent, or Firm*—Christensen O'Connor Johnson Kindness PLLC

(57) ABSTRACT

A temperature maintenance heater assembly 10 for maintaining the temperature of a heated fluid circulating through piping of a bath, including a pipe section 70, base plate 40, control device assembly 30, base plate cover 80, and a heating element 20. The pipe section has an outer wall 72, an inlet 74, and an outlet 76. The control device assembly 30 has a first and second pressure switch 32A and 32B, wherein each of the first and second pressure switches have first and second electrical terminals 34A, 36A, 34B and 36B, pressure sensors 38A and 38B, and switch mechanisms 39A and 39B activated by the pressure sensor 38A and 38B. The base plate 40 has an upper surface 42 and a lower surface 52, wherein the control device assembly 30 is attached to the upper surface 42 of the base plate 40, and the base plate 40 is attached to the outer wall 72 of the pipe section 70. The base plate cover 80 is removably attached to the base plate 40, and wherein the cover 80 encloses the control device assembly 30. The heating element 20 has a first and second electrical contact 22A and 22B, wherein the heating element 20 is housed mainly in the pipe section 70, the electrical contacts 22A and 22B pass through the pipe section outer wall 72 and pass from the lower base plate surface 52 to the upper base plate surface 42, and at least one of the electrical contacts 22 is conductively connected to the control device assembly 30.

12 Claims, 10 Drawing Sheets

BATH TEMPERATURE MAINTENANCE HEATER

FIELD OF THE INVENTION

The present invention relates to heaters for maintaining the temperature of a personal jetted bath, and particularly to an assembly of a heating control unit and a bath temperature maintenance heater element.

BACKGROUND OF THE INVENTION

Many consumers have installed jetted bath tubs in their residences for relaxation. Hotels often also provide their guest rooms with jetted tubs, and likewise the same may be provided by therapeutic facilities. Jetted baths are typically filled with hot water from a tap. The hot water is drawn from the tub, passed through a pump, and reintroduced into the tub through jets to provide a soaking user with therapeutic and invigorating jets of water. As the tub is used during a soaking session, the temperature of the water in the tub gradually cools due to heat loss through the tub wall and to the ambient air. To avoid this cooling, some jetted tubs may be provided with a heater installed in the water circulation system. The heater is used to maintain the bath temperature at near its original temperature.

Early jetted bathtub heaters evolved from spa heaters. A spa heater must not only maintain the temperature of the large water volume contained in the spa, but also must initially raise the temperature of the water from ambient to the desired elevated temperature. Spa heaters having heating capacities of 1500 watts to 3000 watts have been used to maintain the temperature of much smaller jetted tubs, even though those outputs were excessive in relationship to the reason for providing a bathtub heater in the first place, i.e.: to maintain the water temperature of the bathtub to the bathers individual comfort level. A secondary heat source (other than the domestic hot water tank) is required only to rectify the loss of heat due to the cooling of the bath water below the bather's comfort level. Such cooling may be caused by the induction of air into the bath water, or the cooling effect of the bath water over time, or the inability to add additional water to the bath water from a domestic hot water tank that had been exhausted in the initial filling of the tub. While bath heaters must have an output sufficient to maintain the bath temperature during use for these reasons, such heaters need not initially heat the bath water from ambient, and thus have much lower actual power requirements than for a heater used in a spa.

Conventional bath maintenance heaters are larger in heat capacity than strictly needed to maintain bath temperature, as noted above. Therefor, conventional heaters must be regulated to assure they do not heat the bath water to above a safe upper limit. In designing a bath heater, there is also a need to limit the function of such conventional high-output heating devices when abnormal conditions are encountered that would produce an unsafe condition, due to excessively heating the water. The anticipated unsafe conditions include, (based upon the heaters ability to produce unsafe heating levels): dry fire, low flow, restricted flow, interrupted power (allowing for residual heat build-up in the heater vessel), and temperature-regulating control failure. Therefore, a temperature-regulating controller and high level limiting device have been required to avoid a heater operating in an unsafe condition, such as those noted above.

SUMMARY OF THE INVENTION

The present invention provides a temperature maintenance heater assembly that maintains temperature within a control range by selecting a heater element with a maximum power rating such that it is not capable of heating the water to a point where the water temperature at the outlet exceeds a specified temperature when running continuously. Further, temperature control is also maintained by one or more pressure switches, which will shut off the heater element when it senses low flow or no flow of fluid in the piping. In a first embodiment (referred to herein as the "dual pressure switch embodiment"), two pressure switches are provided, one for each leg of the power supply to the heating element. This meets certain industry standards (UL Standards) that all ungrounded power supply conductors to a heater element be opened when abnormal conditions occur. The invention is also workable with only a single pressure switch (referred to herein as the "single pressure switch embodiment").

In the single pressure switch embodiment of the present invention, the temperature maintenance heater assembly for maintaining the temperature of a heated fluid circulating through piping of a jetted bath, includes a heating element having a first and second electrical contact, and a specified power rating. The predetermined maximum power rating of the heating element is selected such that the temperature maintenance heater will maintain the fluid immediately up stream of the heating element within a specified safe temperature range with the heating element operating continuously at its maximum power rating. The control assembly includes a pressure switch having first and second electrical terminals, a pressure sensor, and a switch mechanism activated by the pressure sensor. The control assembly is electrically connected between a power supply and at least one electrical contact of the heating element. The pressure switch of the control assembly may act to interrupt the supply of electricity from the power supply to the heating element when a threshold limit for the flow of fluid through the piping is not met, with the control assembly continuing the supply of electricity to the heating element whenever the threshold limit of fluid flow is met.

In the dual pressure switch embodiment of the present invention, a second pressure switch is also provided. The second pressure switch may be installed in parallel or in series with the first pressure switch. The first pressure switch may be normally open while the second pressure switch may be normally closed. For example, the first pressure switch may be set to actuate to the closed position when the sensed pressure exceeds a predetermined minimum threshold pressure, e.g., 2 pounds per square inch (PSI), to complete the circuit for normal fluid flow, while the second pressure switch may be set to actuate to the open position when the sensed pressure exceeds a predetermined maximum threshold pressure, e.g., 15 PSI, to break the circuit for pressure surges (such as outlet blockage or closure).

In a further aspect of the present invention, the temperature maintenance heater assembly further includes a base plate having an upper surface and a lower surface, a first aperture passing from the upper surface to the lower surface, wherein the control assembly may be attached to the upper surface of the base plate and the pressure sensor placed inside the first aperture.

In a further aspect of the present invention, the temperature maintenance heater assembly further includes a pipe section. The pipe section has an outer wall, an inlet, and an outlet. The control device assembly is attached to the upper surface of the base plate, and the base plate is attached to the outer wall of the pipe section. The heating element has a first and second electrical contact, wherein the heating element is housed mainly in the pipe section, the electrical contacts pass through the pipe section outer wall and pass from the lower base plate surface to the upper base plate surface, and at least one of the electrical contacts is conductively connected to the control device assembly.

In a further aspect of the present invention, the temperature maintenance heater assembly further includes a base plate cover. The base plate cover is removably attached to the base plate, and encloses the control device assembly.

The present invention thus provides a low wattage temperature maintenance heater assembly that, by virtue of its limited maximum power rating heating element, is unable to overcome the heat loss present during bathing. As low-flow and dry-fire conditions may be protected by the control device assembly, the temperature maintenance heater assembly is called upon to also protect the heater element and bather should restricted flow (blockage or minimal flow insufficient to allow for normal operating temperatures to be maintained) be encountered, or for failure to control the temperature within normal operating parameters. The present invention may be practiced in the absence of a temperature-regulating device, instead the control assembly is used in conjunction with the limited maximum power rating heating element solely to respond to unsafe conditions which are flow related.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENTS

Figure 1A:
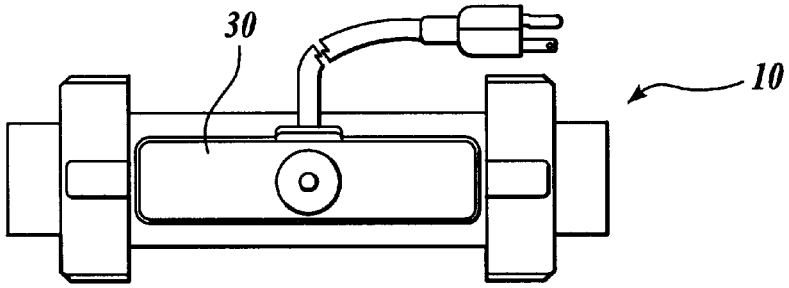
FIGS. 1A, 1B and 1C are top, side and end elevation views, respectively, of a temperature maintenance heater assembly constructed in accordance with the present invention.
Figure 1B:
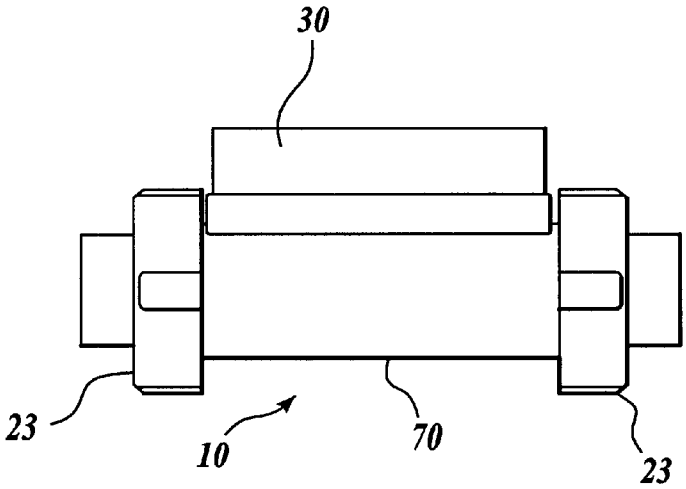
Figure 1C:
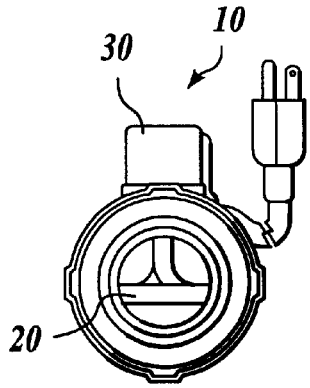

A bath temperature heater assembly 10 constructed in accordance with an embodiment the present invention is shown in FIGS. 1A. 1B and 1C. The assembly 10 includes a heating element 20 housed within a pipe section 70 that is provided with first and second end fittings 23 to enable installation of the assembly in a fluid flow pipe circuit of a jetted bath. It will be understood that as used herein, the term jetted bath includes bath tubs, spas, hot tubs, or other personal soaking devices. The heater assembly 10 further includes a control assembly 30 that controls the supply of power to the heating element 20. The control assembly 30 is mounted on the exterior of the pipe section 70.

Figure 1D:
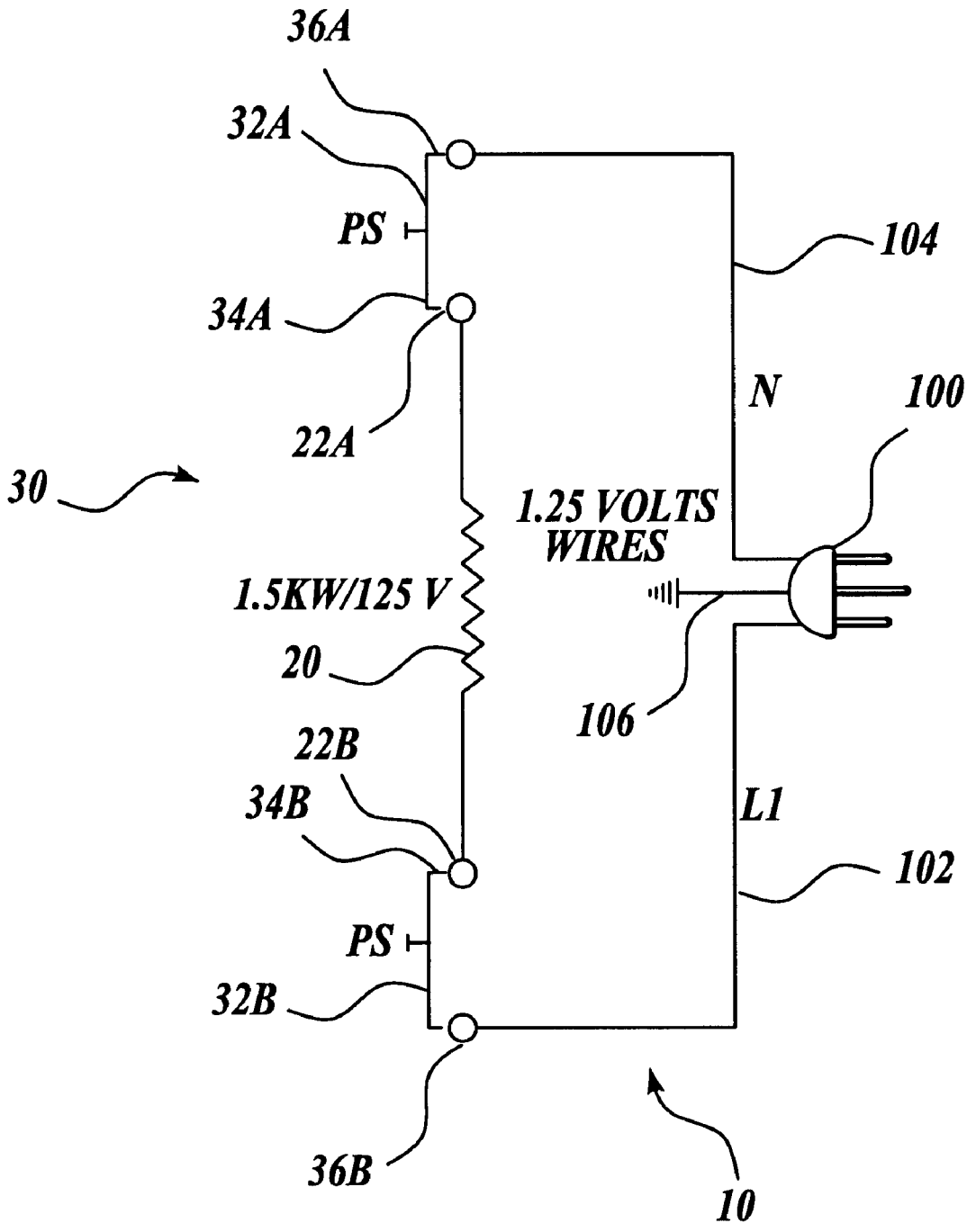
FIG. 1D is a circuit diagram of an embodiment of the electrical components of the temperature maintenance heater assembly of FIG. 1A.

Referring now to FIG. 1D, a circuit diagram of a first embodiment of a temperature maintenance heater assembly 10 of the present invention is shown. The heater assembly 10 includes the heating element 20 and the control assembly 30. The control assembly 30 includes first and second pressure switches 32A and 32B. Each pressure switch 32A and 32B includes first and second electrical terminals 34A and 36A, and 34B and 36B respectively. The circuit diagram here shows the pressure switches 32 in parallel arrangement; it will be understood however that the switches 32A and 32B may alternatively be configured in series. The heating element 20 includes first and second electrical contacts 22A and 22B. The first switch 32A is connected to the heating element 10 first electrical contact 22A by the first electrical terminal 34A. Likewise the second switch 32B is connected to the heating element 20 second electrical contact 22B by the first electrical terminal 34B. The first switch 32A is connected to the neutral lead 104 by the second electrical terminal 36A and the second switch 32B is connected to the hot lead 102 by the second electrical terminal 36B. It will be understood that the neutral lead 104 could alternatively be connected the second switch 32B, and the hot lead 102 connected to the first switch 32A. Thus, the pressure switches 32 act to interrupt the supply of electricity from a power supply via the power cord 100 to the heating element 20.

The circuit shown in FIG. 1D is physically embodied in a control assembly 30 that includes the two switches 32A and 32B which may be mounted on base plate 40 for attachment to the pipe section 70. Diaphragm assemblies enable the switches 32A and 32B to sense pressure inside the pipe section 70. A cover for the base plate enables the control assembly 30 to be sealed from water leakage and user tampering. A power cord 100 may be sealed between the base plate and the cover and attached electrically to the control assembly to provide power to the heating element 10. The heating element 10 has first and second electrical contacts 22A and 22B that extend through apertures in the pipe section, passing through the base plate to be connected to the switches 32A and 32B. The pipe section 70 includes lugs that passing through the base plate to secure the base plate to the pipe section. Each of these components will now be described in turn.

Figure 2:
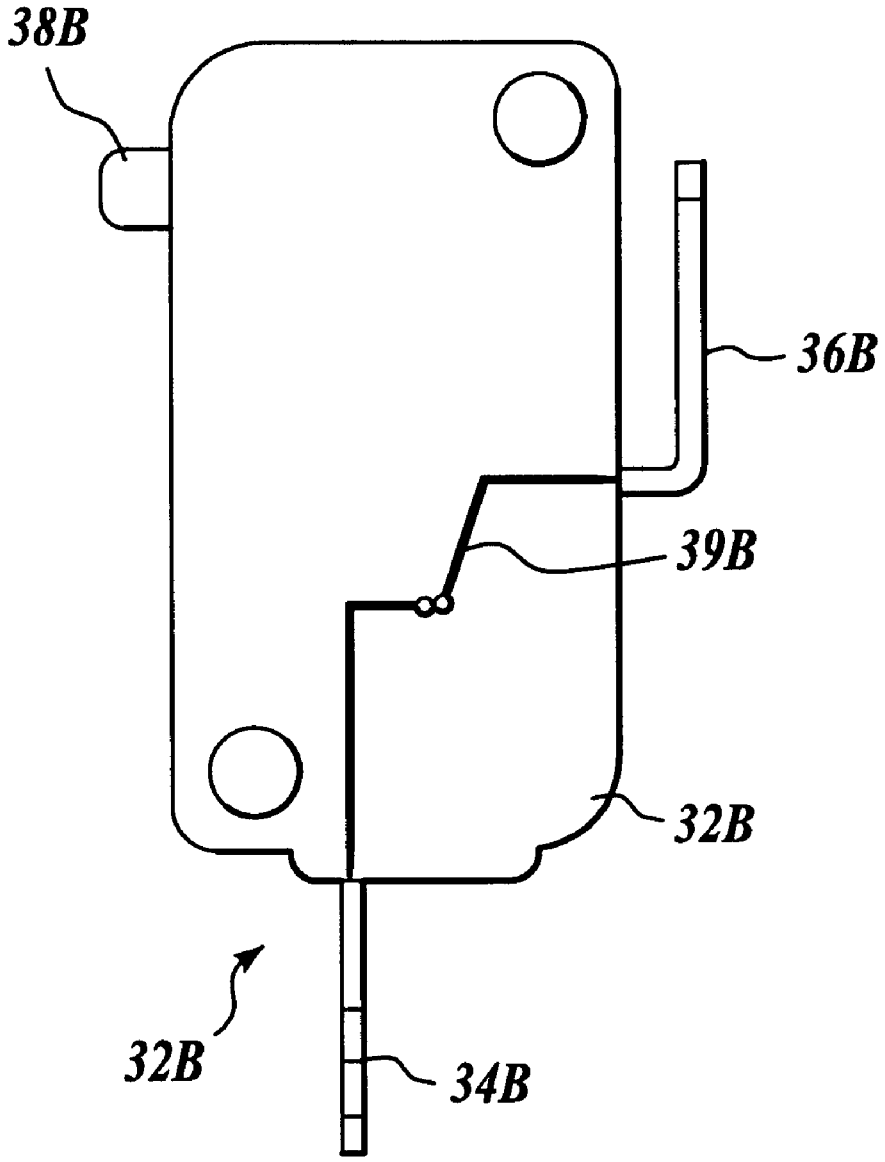
FIG. 2 is a side view of a normally closed pressure switch suitable for use in the circuit of FIG. 1D.

Referring now to FIG. 2, a side view of a normally closed second pressure switch 32B is shown. The second switch 32B includes first and second electrical terminals 34B and 36B, pressure sensor 38B, and switch mechanism 39B activated by the pressure sensor 38B. As illustrated, the switch mechanism 39B may suitably be normally closed.

Figure 3:
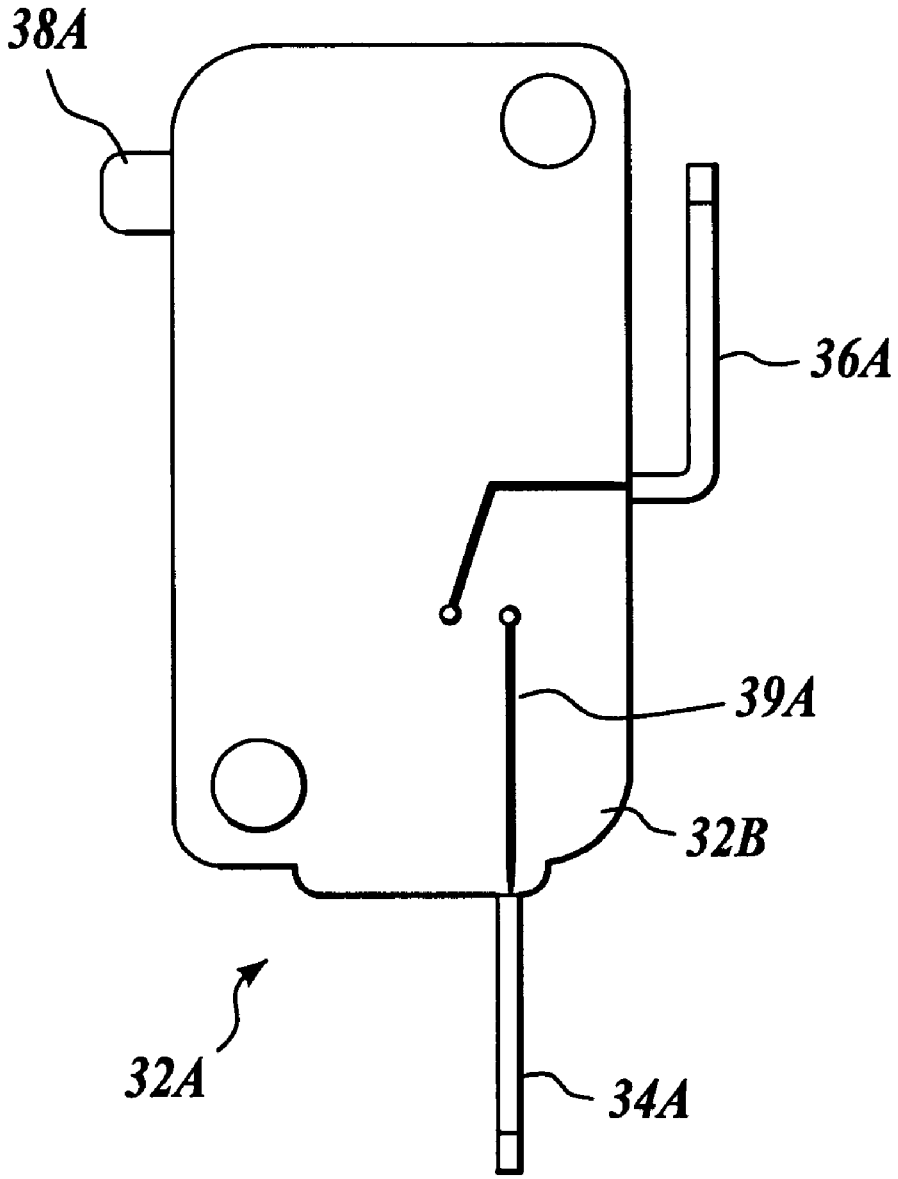
FIG. 3 is a side view of a normally open pressure switch suitable for use in the circuit of FIG. 1D.

Referring now to FIG. 3, a side view of a normally open first pressure switch 32A is shown. The first switch 32A includes first and second electrical terminals 34A and 36A, pressure sensor 38A, and switch mechanism 39A activated by the pressure sensor 38A. As illustrated, the switch mechanism 39A may suitably be normally open.

While a normally closed switch 39B and normally open switch 39A are shown, other configurations are within the scope of the present invention.

Figure 4:
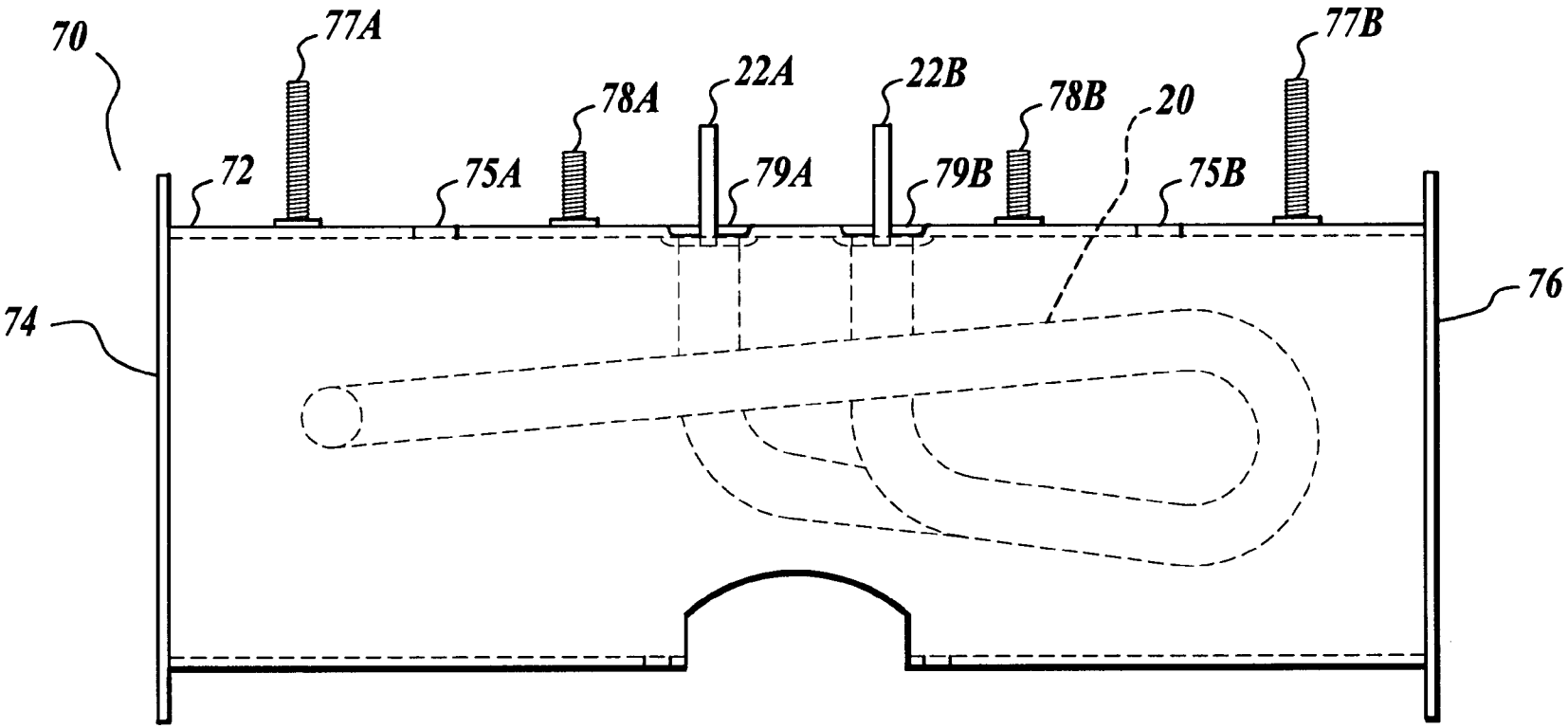
FIG. 4 is a cross-sectional side view of a heating element housed in a pipe section of the assembly of FIG. 1A.

Referring now to FIG. 4, a cross-sectional side view of a heating element 20 housed in the pipe section 70 is shown. The temperature maintenance heater assembly 10 may be installed in a pipe section 70. Preferably the pipe section 70 includes an outer wall 72, inlet 74, outlet 76, first and second outer lugs 77A and 77B, first and second inner lugs 78A and 77B, and first and second pipe heater contact apertures 79A and 79B. The lugs 78 and 79 and the apertures 79 are preferably all located along a single bi-sectional line running from the inlet 74 to the outlet 76. Moving from the inlet 74 to the outlet 76 along the bi-sectional line, the first outer lug 77A is located near the inlet 74. Moving from the outlet 76 to the inlet 74 along the bi-sectional line, the second outer lug 77B is located near the outlet 76. The first and second pipe heater contact apertures 79A and 79B are located near the center of the pipe segment 70, between the first and second outer lugs 77A and 77B. The first inner lug 78A is located between the first pipe heater contact aperture 79A and the first outer lug 77A. The second inner lug 78B is located between the second pipe heater contact aperture 79B and the second outer lug 77B. The first pipe pressure sensor aperture 75A is located between the first outer lug 77A and the first inner lug 78A. Likewise, the second pipe pressure sensor aperture 75B is located between the second outer lug 77B and the second inner lug 78B.

Figure 5A:
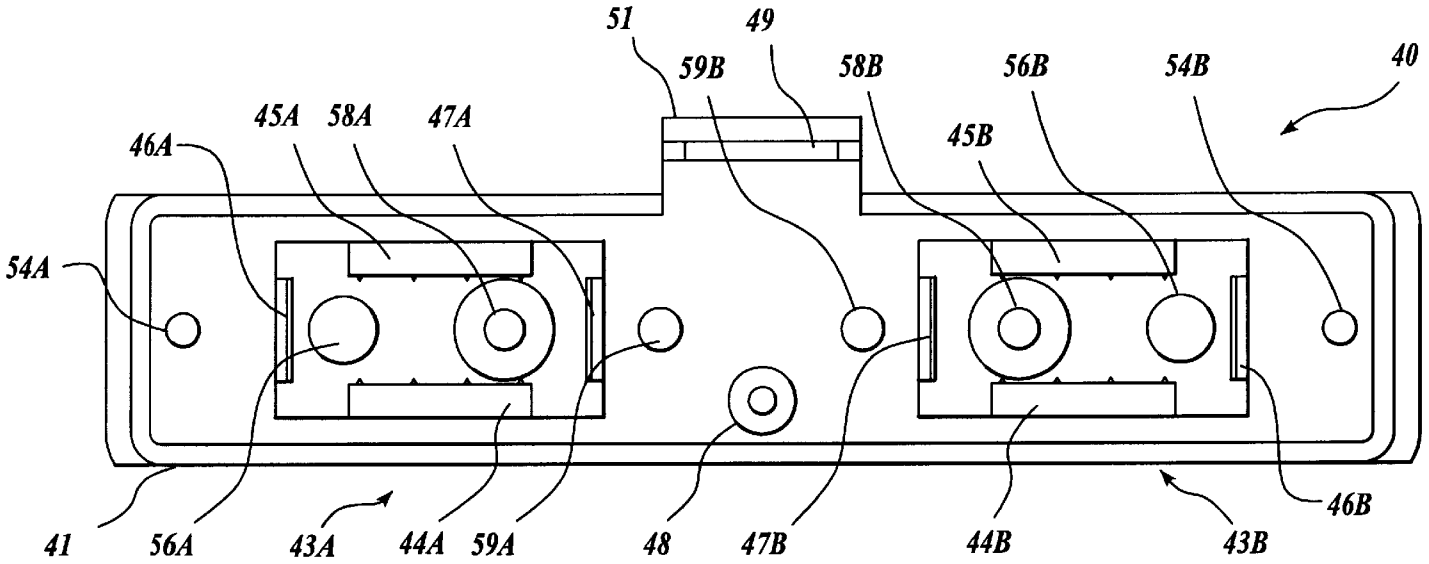
FIGS. 5A and 5B are top and side perspective views of a base plate of the assembly of FIG. 1A.
Figure 5B:
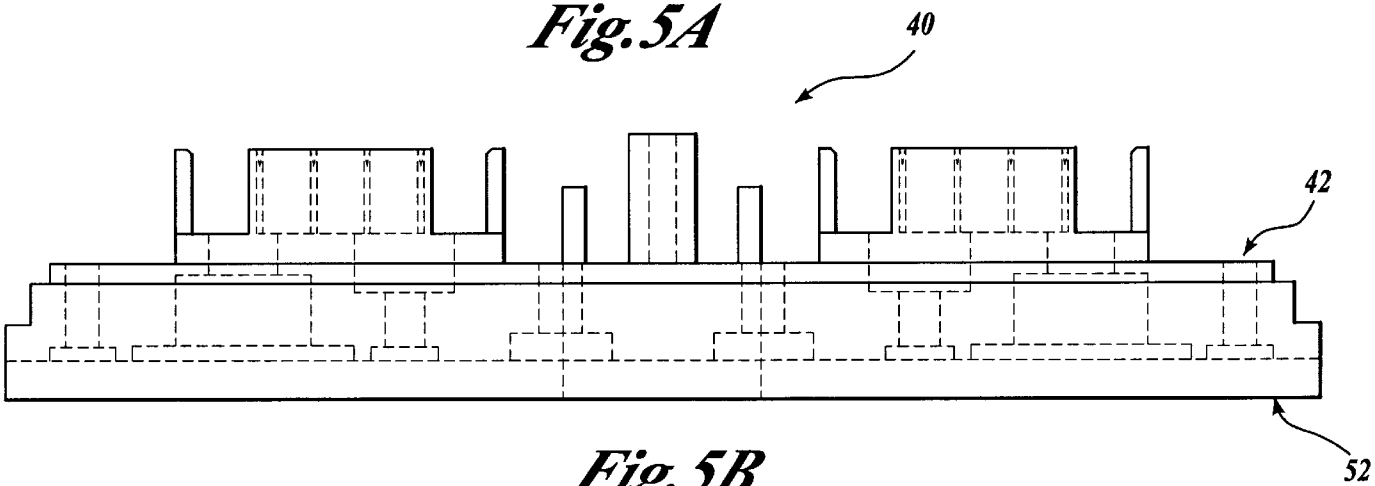

Referring now to FIG. 5A, a perspective view of a base plate 40 is shown. The base plate 40 is used to mount the switches 32A and 32B onto the pipe section 70, and provides for electrical connection between the first and second electrical contacts 22A and 22B of the heating element 30 and the switches. Base plate 40 is generally rectangular in configuration, and includes an upper surface 42, a lower surface 52, a front side 41, and a back side 51. The base plate 40 includes apertures passing from the lower surface 52 to the upper surface 42, including first and second outer lug apertures 54A and 54B, first and second pressure sensor apertures 56A and 56B, first and second inner lug apertures 58A and 58B, and first and second base heater contact apertures 59A and 59B. Working out from the center of the base plate 40 and running along the long dimension of the base plate, the first and second base heater contact apertures 59A and 59B are located towards the center of the base plate 40. The first and second outer lug apertures 54A and 54B are located away from the center and towards the outer edges of the base plate 40. The first inner lug aperture 58A is located between the first outer lug aperture 54A and the first base heater contact aperture 59A. Likewise, the second inner lug aperture 58B is located between the second outer lug aperture 54B and the second base heater contact aperture 59B. The first pressure sensor aperture 56A is located between the first outer lug aperture 54A and the first inner lug aperture 58A. Likewise, the second pressure sensor aperture 56B is located between the second outer lug aperture 54B and the second inner lug aperture 58B.

On the upper surface 42, the base plate includes first and second switch fittings 43A and 43B, a cover fitting 48, and a power cord fitting 49. The first switch fitting 43A may have first and second sidepieces 44A and 45A and first and second end pieces 46A and 47A. Likewise, the second switch fitting 43B may have first and second sidepieces 44B and 45B and first and second end pieces 46B and 47B. The sidepieces 44 include rough surfaces or small projections that project toward the front side 41 of base plate 40. Likewise, the sidepieces 45 include rough surfaces or small projections that project toward the backside 51 of base plate 40. These rough surfaces may exert a mechanical force against the sides of a switch that is inserted into the fitting 43, to retain the switch in place. In an alternative embodiment, the switch fittings 43 may have holes (not shown) to accept screw, bolts, or other fastening devices to attach the switches to the switch fittings 43.

The cover fitting 48 is located towards the front side 41 and approximately at the center of the base plate 40. The cover fitting 48 is a hollow column with grooves on the inner surface to engage corresponding threading of a cover fastener.

The power cord fitting 49 is located towards the backside 51 and approximately at the center of the base plate 40. The power cord fitting 49 has a general rectangular shape and extends out from the base plate perpendicular to the surface of the backside 51. The power cord fitting 49 has two vertical columns placed at the corners of the power cord fitting 49 that are the farthest from the back side 51. The power cord fitting 49 also has a groove running parallel to the backside 51 of base plate 40 and positioned between the vertical columns and the backside 51.

Figure 6:
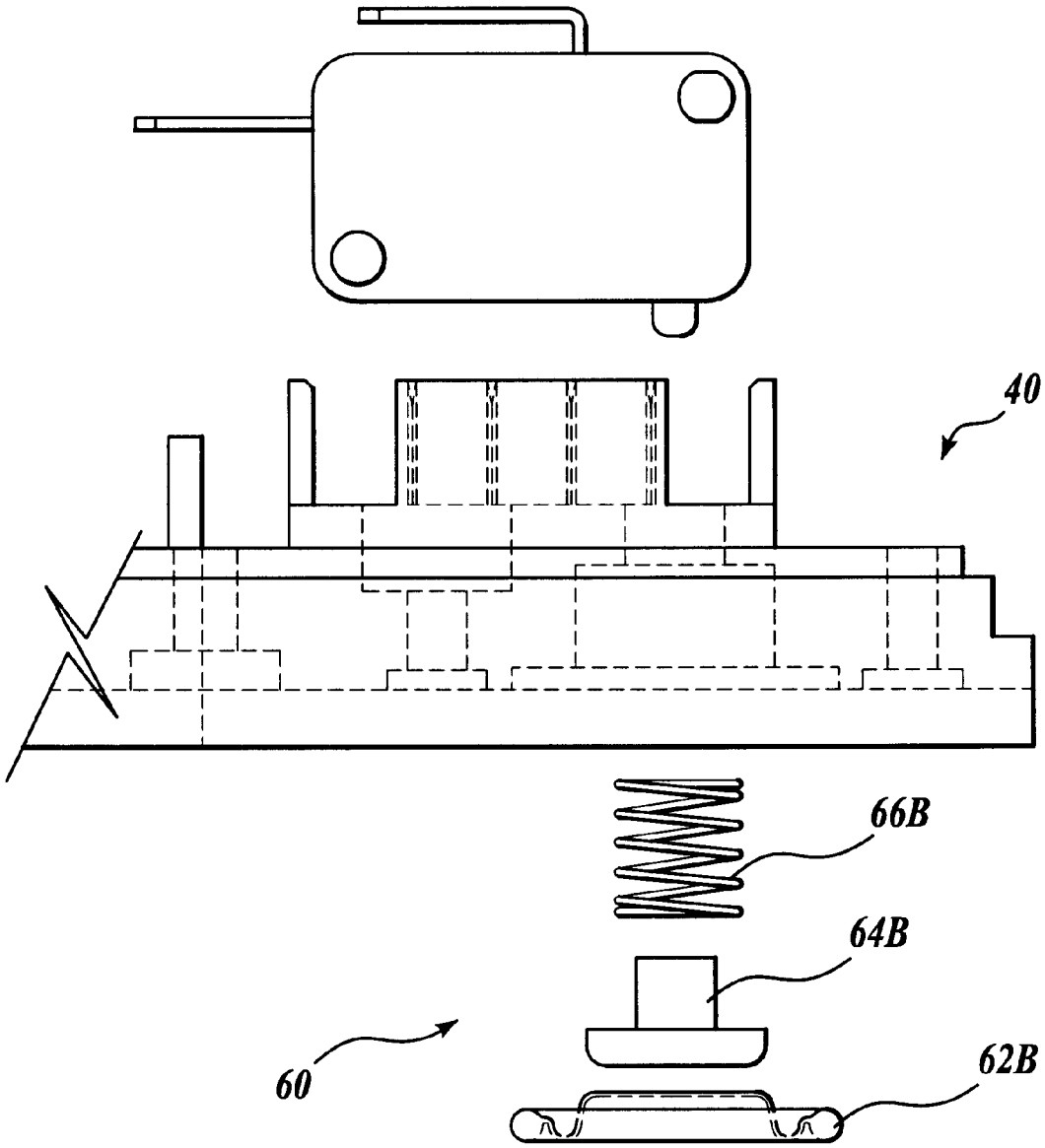
FIG. 6 is an exploded side view of a diaphragm and base plate assembly of the assembly of FIG. 1A.

Referring now to FIGS. 4, 5A, and 6, an exploded side view of a diaphragm assembly 60 is shown. The diaphragm assembly 60 reacts to positive or negative pressure differentials between ambient pressure and the pressure inside the pipe and acts upon the pressure sensor of the pressure switch in response to this pressure differential. The diaphragm assembly 60 includes first and second diaphragm 62A and 62B, first and second pusher 64A and 64B, and first and second spring 66A and 66B. The base plate 40 may be attached to the outer wall of the pipe section. When this is done diaphragm assembly 60 may be placed within the pressure sensor aperture 56 and in fluid flow communication with the pipe pressure sensor aperture 75 of the pipe section 70 The diaphragm 62 is positioned directly on top of the pipe pressure sensor aperture 75. The pusher 64 has a broad base that is positioned directly on top of the diaphragm 62, and a narrower column portion that extends vertically from the broad base. At one end, the spring 66 is positioned directly against the base plate 40 along an inner lip of the pressure sensor aperture 56, and 4 the other end the spring 66 is positioned about the pusher 64 column portion and against the broad base. The diaphragm 62 flexibly responds to pressure through the pipe pressure sensor aperture 75 and acts upon the pusher 64. The pusher 64 in turn acts upon the spring 66. The spring pushes against the base plate 40. Once switch 32 is inserted into the switch fitting 43, the pressure sensor extends into the pressure sensor aperture 56, the pusher 64 may also act upon the pressure sensor 38 to activate the pressure switch 32.

Figure 7:
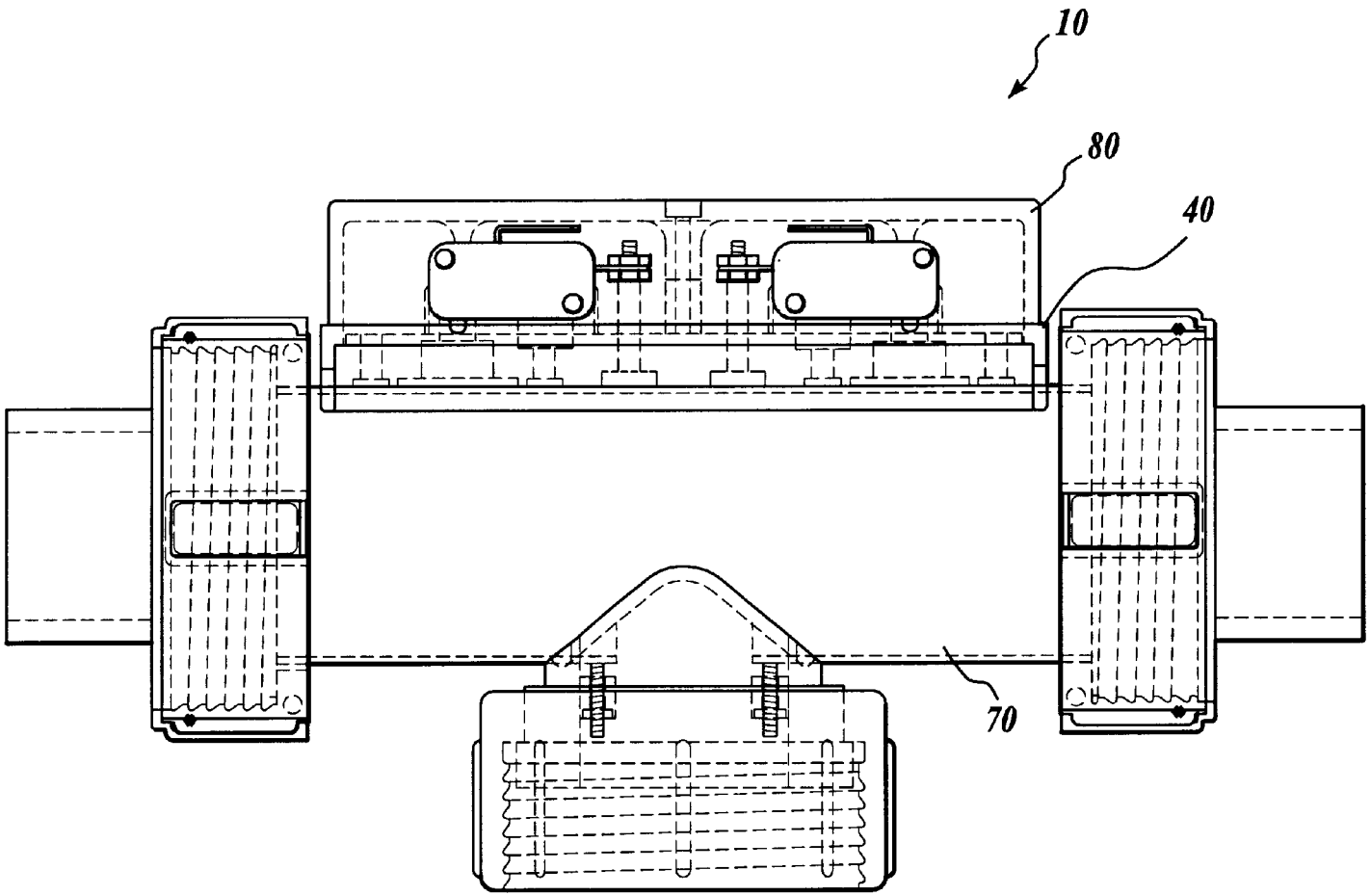
FIG. 7 is a cross-sectional side view of the temperature maintenance heater assembly of FIG. 1A.

Referring now to FIG. 7, a cross-sectional side view of the temperature maintenance heater assembly 10 is shown. In this view, the base plate 40 has been attached to the pipe section 70, and the switches 32A and 32B have been attached to the base plate 40 and to the heating element 20. The base plate may be secured to the pipe section 70 by inserting the outer lugs 77A and 77B through corresponding outer lug apertures 54A and 54B, as well as inserting the inner lugs 78A and 78B into corresponding inner lug apertures 58A and 58B, and securing the protruding lug ends against the upper surface 42 of base plate 40. The pipe section 70 and the base plate 40 may be secured together with a water-proof seal.

Additionally, switches 32A and 32B may be retained on the base plate by the switch fittings 43A and 43B. Once inserted into the fittings 43A and 43B, the pressure sensors 38 extend into the corresponding pressure sensor apertures 56.

The heating element 20 electrical contact 22A and 22B may extend through the pipe segment 70 pipe heater contact apertures 79A and 79B, as well as extending though the base plate 40 heater contact apertures 59A and 59B. The portion of the electrical contacts 22 extending past the upper surface 42 of base plate 40 may be contacted electrically with the control assembly 30.

Figure 8C:
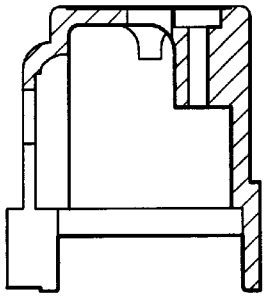
FIGS. 8A, 8B, 8C, and 8D are top, side, and end perspective views of a base plate cover of the assembly of FIG. 1A.
Figure 8D:
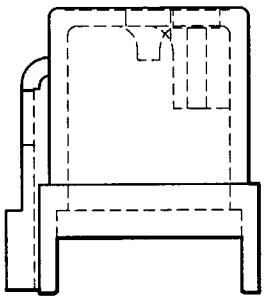
Figure 8A:
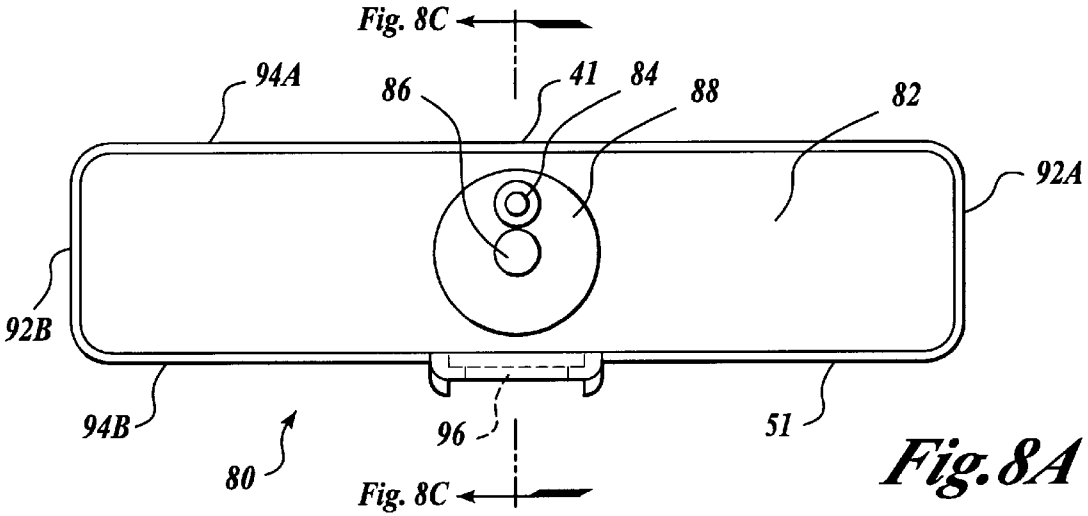
Figure 8B:
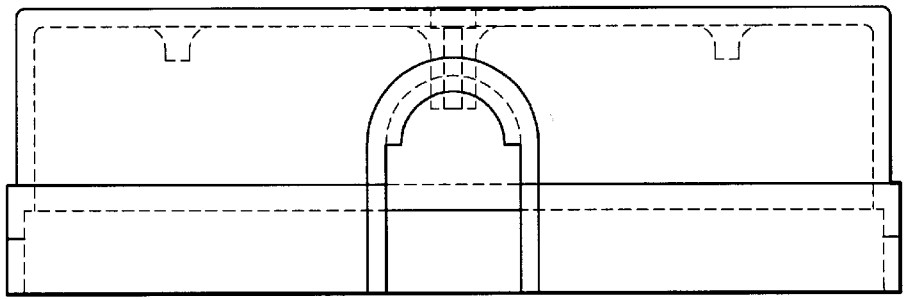

Referring now to FIG. 8A, a perspective view of a base plate cover 80 is shown. The base plate cover 80 includes a top wall 82, first and second end walls 92A and 92B, and first and second side walls 94A and 94B. The end walls 92 and sidewalls 94 are constructed to removably seal against base plate and enclose the control assembly 30. The seal between the cover 80 and the base plate may be a waterproof seal. The top wall 82 includes a cover fastener assembly 84 to removably secure the cover 80 to the base plate. In one embodiment the cover 80 has a fastener aperture into which a screw may be inserted and threaded to the base plate cover fitting 48. A tamperproof seal 88 may be provided for covering the fastener assembly 84, to restrict the ability to remove the cover 80. Additionally, an indication light 86 may be incorporated into the cover to provide a visual indication as to whether the temperature maintenance device is functioning properly. It will be understood that as used herein, the indication light 86 may comprise a light emitting diode (LED), a neon light, or some other light source. The second side wall 94B includes a power cord aperture 96 to accept and retain power cord. The power cord aperture 96 corresponds to and accepts the power cord fitting, so that when the base plate 40 and cover 80 are joined together about power cord, the power cord is retained and partially sealed within the cover 80 and base plate.

Figure 9B:
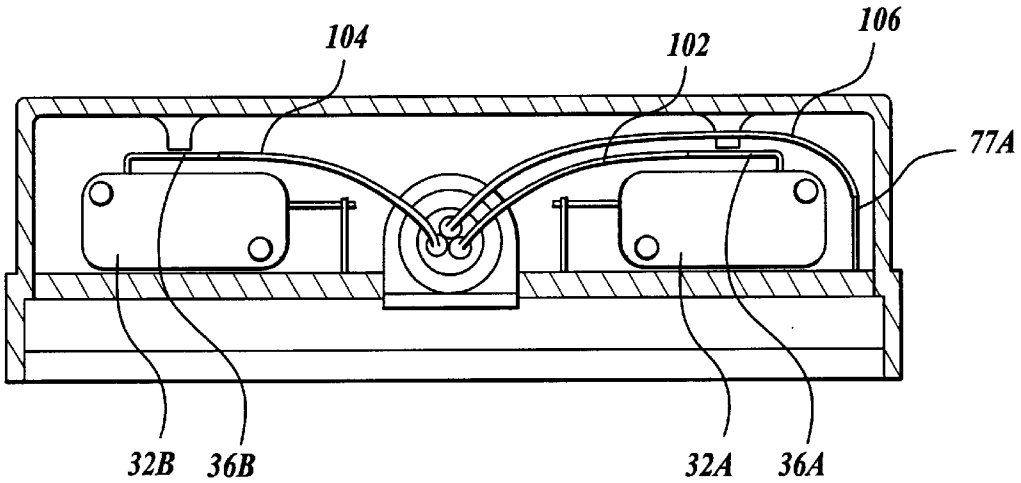
FIGS. 9A and 9B are side and end perspective views of a power cord of the assembly of FIG. 1A.
Figure 9A:
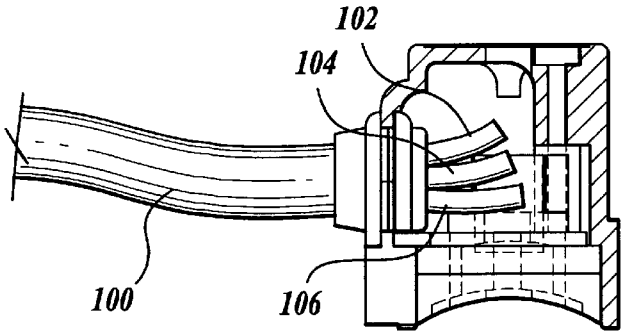

Referring now to FIG. 9A, a perspective view of a power cord 100 is shown. The power cord 100 includes a hot lead 102, a neutral lead 104, and a ground lead 106. The hot and neutral leads 102 and 104 may be connected to the second electrical terminals 36A and 36B to supply power to the control assembly 30. The ground lead 106 may ground the temperature maintenance heater assembly 10 by conductively connecting to one of the lugs attached to the pipe segment 70, preferably outer lugs 77A or 77B. To facilitate grounding, it is preferred that the pipe segment 10 also be conductive.

In a preferred embodiment, the first pressure switch 32A may be actuated by the pressure differential between the atmosphere and the pump pressure inside the heater assembly 10 when the pressure inside the pipe section 70 exceeds a prescribed low pounds per square inch (PSI) rating. Preferably, the first pressure switch 32A is normally open and may be closed when actuated. The second pressure switch may be actuated by the pressure differential between the atmosphere and the pump pressure inside the heater assembly when the pressure inside the pipe section 70 exceeds a prescribed high PSI rating. Preferably, the second pressure switch 32B is normally closed and may be opened when actuated. In one embodiment the first pressure switch will be set to actuate to the closed position at 2 PSI to complete the circuit for normal fluid flow, while the second pressure switch will be set to actuate to the open position at 15 PSI to break the circuit for pressure surges (such as outlet blockage or closure).

The safety issues involving the following abnormal conditions are addressed by the temperature maintenance heater assembly 10: dry-fire protection, temperature-control, temperature-limiting, low water, no water, interrupted power, blocked suction cover (low or no flow abnormal), adjustable jets in off position (low or no flow abnormal), or cavitation of the pump (low or no flow abnormal). Each of these abnormal conditions will be discussed below with indication as to the method of safety control provided by the temperature maintenance heater assembly 10.

The present invention's design incorporates the first pressure switch 32A that senses the loss of flow in the pipe section 70 and opens when the pressure inside the pipe section 70 falls below 2 PSI. This loss of pressure is an indication of loss of flow and is a common method of dry-fire protection. Low water conditions will result in the pump not priming sufficiently to produce a PSI rating above the 2 PSI switch setting, therefore low water abnormal condition is protected within the control assembly 30 containing the first pressure switch 32A. This circuit will not allow the heater element to function until the low water condition is corrected by the manual action of the user.

A no water abnormal condition is protected in the same manner as low water abnormal condition, by the inclusion of the first pressure switch 32A in the control assembly 30. Should a no water condition be encountered, first pressure switch 32A will not close and the heater element 20 cannot be energized, nor will energizing of the heating element take place until the user corrects the no water condition by manual action.

Blocked suction will also result in low water pressure in the heater assembly 10 caused by blockage on the inlet side of the heater assembly 10. This will result in the heater element 20 being shut down by first pressure switch 32A and the heater element 20 will remain off until the user manually corrects the unsafe condition by removing the blockage and restoring the system to normal safe operating status.

If air is introduced into the impeller of the pump in sufficient quantity, it is possible that the air entrainment will result in loss of pressure inside the pipe section 70. This is safeguarded in the present invention's heater assembly 10 by first pressure switch 32A which will open on the loss of pressure and cannot be reset without the user taking a manual action of correcting the source of the cavitation and restoring the system to normal safe operating condition.

The present invention's design incorporates the limited maximum power rating output resistance element 20. It is preferred that the heating element 20 has a predetermined wattage selected to maintain bath temperature. For example, the heating element 20 may be a maintenance heater of 700 watts or less (to be determined upon testing). This element is capable of maintaining the water temperature of a specified bath within the maximum allowable operating temperatures, thus providing temperature-control without the need for a temperature-regulating thermostat.

The present invention's approach to providing a temperature-limiting control is in providing the required control assembly 30 in conjunction with the heater element 20 with a limited maximum power rating. The first pressure switch 32A is normally open and contributes to the temperature-limiting control by sensing a loss in pressure that would be associated with any abnormal condition in the system that would limit or reduce the flow of water through the heater assembly 10, which would be the result of an unsafe condition. This is accomplished when the first switch 32A senses operating pressures below the 2 PSI set-point (or other predetermined minimum flow threshold), and remains open. The first switch 32A cannot be automatically reset without the user first manually correcting the unsafe condition that caused the switch to open and interrupt the power to the heating element. The switch can only be reset by the users manual action, regardless of any other of the circuits components opening or closing.

The present invention's use of a low wattage heating element 20 also precludes residual heat buildup within the pipe section 70 should power be interrupted to the heater element 20 or pump. Shut-down upon power interruption is instantaneous and no water temperature in excess of 120° F. within the pipe section 70 or adjacent piping is possible. Therefore there is no possibility of scalding the user resulting from residual heat buildup caused by interrupted power. The control assembly 10 also incorporates the first pressure switch 32A as part of the circuit protecting the system from abnormal operating conditions caused by interrupted power, therefore, the user must initiate a manual action to remedy the unsafe condition before the heater element 20 can be returned to normal operating status.

The control device assembly 30 may also include the second pressure switch 32B that is normally closed. The second switch 32B preferably opens at 15 PSI and is used to protect the system from damage when the water flow through the heater assembly 10 is blocked on the outlet side 76. When the second switch 32B senses operating pressure in excess of 15 PSI (or other predetermined maximum flow threshold), the switch opens and interrupts power to the heating element 20. The second switch 32B cannot be automatically reset without the user first removing the blockage that caused the switch to react to an unsafe condition, regardless of any other of the circuits components opening or closing.

Bath manufacturers have designated some, or in rare cases, all of their jets as "fully adjustable" to allow for the water flow directed from the jet to adjusted so that the flow is reduced by 80% or with some designs, be turned off completely. If multiple jets are used and only a portion are fully adjustable, a blocked flow condition would be avoided. However, if all are fully adjustable, water will cease to flow across the heater element and the heat in the heater assembly can rise to exceed 122° F. and if this were allowed to occur, a scalding potential would be present. The present invention's control assembly prevents this through the use of the second pressure switch 32B which senses the increased pressure in the heater assembly caused by the outlet side 76 of the heater assembly 10 being blocked (restricted) and when the pressure exceeds 15 PSI, the second pressure switch 32B opens immediately and interrupts all power to the heating element 20. Power to the heating element 20 cannot be restored by any other action other than a manual action by the user such as opening the jets to allow normal flow to resume.

Although the embodiment described above detailed a two switch embodiment, it will be understood that a one switch embodiment could be practice without departing from the teaching of the present invention. Structurally, a one switch temperature maintenance device would be very similar to the two switch embodiment. Only one switch fitting 43, pressure sensor aperture 56, pipe pressure sensor apertures 75, and diaphragm assembly need to be provided. Additionally either the hot lead 102 or the neutral lead 104 will be connected directly to a heating element 20 electrical contact 22. While the two switch embodiment has the advantages associated with including normally closed second pressure switch 32B discussed below, the one switch device has many of the same advantages. In an alternative embodiment, a double pole switch may be used instead of a single pole switch. Additionally, while the two switch embodiment above describes an embodiment with a normally closed switch used with a normally open switch, the invention may be practiced where all switches may be normally open, or normally closed.

It will be understood that while the embodiments described herein have described the first pressure switch 32A as being normally open, and on the outlet side of a pumping system, variations may be made without departing from the present invention. For instance, the first pressure switch 32A could operate in a similar manner if it were normally close and located instead on the suction side of the pumping system. In this alternative embodiment, the diaphragm assembly 60 would be constructed to respond to suction instead of positive pressure. So that the diaphragm assembly 60 will respond to the negative pressure accompanying normal operating conditions on the suction side of the pump, the diaphragm 62A would pull on the pressure sensor 38A via the spring 66A instead of pushing the sensor 38A.

In an alternative embodiment the control device assembly 30 may further include a thermal sensor. Preferably, the thermal sensor is normally closed. This thermal sensor opens if the case temperature of the pipe section 70 exceeds the maximum allowable temperature. When in the tripped or open position, power is interrupted to the second pressure switch 32B and thus to the heating element 20. This thermal sensor may be an automatic reset device, but it does not act as the temperature-limiting control by itself. Rather, after it opens the circuit, if it resets without the system being returned to a normal safe operating condition by the user's manual action, the heater element 20 will still not energize. The thermal sensor will not open if either first pressure switch 32A or second pressure switch 32B are in a fault condition, unless a high case temperature is detected. As a high case temperature can only result when a high-pressure loss of flow unsafe condition (blockage) or a low-pressure loss of flow (low water, no water, pump cavitation, or low flow) unsafe condition is encountered (which are protected by either first pressure switch 32A or second pressure switch 32B), the temperature sensing capability is used only as a safety back-up in the case of failure of first pressure switch 32A or second pressure switch 32B.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A temperature maintenance heater assembly for maintaining the temperature of a heated fluid circulating through piping of a bath, comprising: a heating element having a first and second electrical contact, and a specified power rating; a control assembly having a pressure switch, wherein the pressure switch has a first and second electrical terminal, a pressure sensor, and a switch mechanism activated by the pressure sensor, the control assembly being electrically connected between a power supply and at least one electrical contact of the heating element; a base plate having an upper surface and a lower surface, and a first aperture passing from the upper surface to the lower surface, wherein the control assembly may be attached to the upper surface of the base plate and the pressure sensor placed inside the first aperture; and a diaphragm placed on the lower surface of the base plate and at least partially within the first base plate aperture, the base plate being sealed about the diaphragm and over a first hole in a segment of piping of the bath, the diaphragm being in fluid flow communication with the fluid in the piping, and may act upon the pressure sensor in response to a pressure gradient between the pressure in the pipe and ambient pressure outside the pipe; wherein the pressure switch of the control assembly acts to interrupt the supply of electricity from the power supply to the heating element when a threshold limit for fluid flowing through the piping is not met, the control assembly continuing the supply of electricity to the heating element whenever the threshold limit of fluid flow is met; and wherein the predetermined maximum power rating of the heating element is selected such that the temperature maintenance heater will maintain the fluid immediately up stream of the heating element within a specified safe temperature range with the heating element operating continuously at its maximum power rating.

2. The temperature maintenance heater assembly of claim 1 wherein a base plate cover may be removably attached to the base plate, and wherein the cover encloses the control device assembly.

3. The temperature maintenance heater assembly of claim 2 wherein the base plate cover further comprises a tamper proof portion to restrict removal of the cover.

4. The temperature maintenance heater assembly of claim 2 wherein the base plate cover further comprises an indication light.

5. The temperature maintenance heater assembly of claim 1 wherein the pressure switch is a double pole switch.

6. The temperature maintenance heater assembly of claim 1 wherein the control device assembly further comprises a second pressure switch.

7. The temperature maintenance heater assembly of claim 6 wherein the first pressure switch may control a first leg of the power supply, and the second pressure switch may control a second leg of the power supply.

8. The temperature maintenance heater assembly of claim 6 wherein the first pressure switch is normally open, wherein the second pressure switch is normally closed, and the second pressure switch actuates at a higher pressure than the first pressure switch.

9. A temperature maintenance heater assembly for maintaining the temperature of a heated fluid circulating through piping of a bath, comprising:

a pipe section with an outer wall, an inlet, and an outlet;

a control device assembly having first and second pressure switches;

a base plate having an upper surface and a lower surface, wherein the control device assembly is attached to the upper surface of the base plate, and the base plate is attached to the outer wall of the pipe section; and a heating element having a first and second electrical contact, wherein the heating element is housed mainly in the pipe section, the electrical contacts pass through the pipe section outer wall and pass from the lower base plate surface to the upper base plate surface, and at least one of the electrical contacts is conductivity connected to the control device assembly.

10. A temperature maintenance heater assembly for maintaining the temperature of a heated fluid circulating through piping of a bath, comprising:

a pipe section with an outer wall, an inlet, and an outlet;

a control device assembly having a first and second pressure switch, wherein each of the first and second pressure switches have first and second electrical terminals, pressure sensors, and switch mechanisms activated by the pressure sensor;

a base plate having an upper surface and a lower surface, wherein the control device assembly is attached to the upper surface of the base plate, and the base plate is attached to the outer wall of the pipe section;

a base plate cover removably attached to the base plate, and wherein the cover encloses the control device assembly;

a heating element having a first and second electrical contact, wherein the heating element is housed mainly in the pipe section, the electrical contacts pass through the pipe section outer wall and pass from the lower base plate surface to the upper base plate surface, and at least one of the electrical contacts is conductively connected to the control device assembly; and absence of a temperature sensitive device.

11. A temperature maintenance heater assembly for maintaining the temperature of a heated fluid circulating through piping of a bath, comprising:

a heating element having a first and second electrical contact, and a specified power rating; and a control assembly having a first and a second pressure switch, wherein each pressure switch has a first and second electrical terminal, pressure sensor, and switch mechanism activated by the pressure sensor, the control assembly being electrically connected between a power supply and at least one electrical contact of the heating element;

wherein the pressure switches of the control assembly act to interrupt the supply of electricity from the power supply to the heating element when a threshold limit for fluid flowing through the piping is not met, the control assembly continuing the supply of electricity to the heating element whenever the threshold limit of fluid flow is met; and wherein the predetermined maximum power rating of the heating element is selected such that the temperature maintenance heater will maintain the fluid immediately up stream of the heating element within a specified safe temperature range with the heating element operating continuously at its maximum power rating.

12. A temperature maintenance heater assembly for maintaining the temperature of a heated fluid circulating through piping of a bath, comprising:

a heating element having a first and second electrical contact;

a control assembly having a pressure switch, wherein the pressure switch has a first and second electrical terminal, a pressure sensor, and a switch mechanism activated by the pressure sensor, the control assembly being electrically connected between a power supply and at least one electrical contact of the heating element;

a base plate having an upper surface and a lower surface, and a first aperture passing from the upper surface to the lower surface, wherein the control assembly may be attached to the upper surface of the base plate and the pressure sensor placed inside the first aperture; and a diaphragm placed on the lower surface of the base plate and at least partially within the first base plate aperture, the base plate being sealed about the diaphragm and over a first hole in a segment of piping of the bath, the diaphragm being in fluid flow communication with the fluid in the piping, and may act upon the pressure sensor in response to a pressure gradient between the pressure in the pipe and ambient pressure outside the pipe;

wherein the pressure switch of the control assembly acts to interrupt the supply of electricity from the power supply to the heating element when a threshold limit for fluid flowing through the piping is not met, the control assembly continuing the supply of electricity to the heating element whenever the threshold limit of fluid flow is met.

* * * * *